US009732640B2

(12) United States Patent
Pasqualetto et al.

(10) Patent No.: US 9,732,640 B2
(45) Date of Patent: Aug. 15, 2017

(54) METHOD FOR CONTROLLING AND MONITORING AN ELECTROMAGNET, IN PARTICULAR IN A VARIABLE VALVE LIFT CONTROL DEVICE

(71) Applicants: CONTINENTAL AUTOMOTIVE FRANCE, Toulouse (FR); CONTINENTAL AUTOMOTIVE GmbH, Hannover (DE)

(72) Inventors: Angelo Pasqualetto, Toulouse (FR); Jean-Marie Quintin, Tournefeuille (FR)

(73) Assignees: CONTINENTAL AUTOMOTIVE FRANCE, Toulouse (FR); CONTINENTAL AUTOMOTIVE GMBH, Hannover (DE)

( * ) Notice: Subject to any disclaimer, the term of this patent is extended or adjusted under 35 U.S.C. 154(b) by 19 days.

(21) Appl. No.: 14/661,069

(22) Filed: Mar. 18, 2015

(65) Prior Publication Data

US 2015/0267572 A1 Sep. 24, 2015

(30) Foreign Application Priority Data

Mar. 19, 2014 (FR) ..... 14 52278

(51) Int. Cl.
*F01L 9/04* (2006.01)
*F01L 13/00* (2006.01)
*H01F 7/18* (2006.01)

(52) U.S. Cl.
CPC ..... *F01L 13/0015* (2013.01); *H01F 7/18* (2013.01)

(58) Field of Classification Search
CPC ..... F01L 13/0015; H01F 7/18
USPC ..... 123/90.11, 90, 12, 90.15; 251/129.01
See application file for complete search history.

(56) References Cited

U.S. PATENT DOCUMENTS 6,164,322 A * 12/2000 Najmolhoda ..... F15B 13/024 137/539
2015/0028840 A1 1/2015 Pasqualetto

FOREIGN PATENT DOCUMENTS

FR 2986341 A1 8/2013
WO 2011005103 A1 1/2011

OTHER PUBLICATIONS

French Search Report, dated Nov. 14, 2014, from corresponding French application.

* cited by examiner

*Primary Examiner* — Ching Chang
(74) *Attorney, Agent, or Firm* — Young & Thompson

(57) ABSTRACT

Disclosed is a control and monitoring method via H bridge of an electromagnet including a solenoid through which a current can be passed in one direction and in the opposite direction. The solenoid delivers a signal corresponding to a mechanical locking movement. Once a current flows in the solenoid, the bridge switches automatically into high impedance with all transistors thereof blocked. A measurement is then taken at the terminals of the solenoid to verify the locked state of the electromechanical system.

17 Claims, 4 Drawing Sheets

| | PWM | DIR | DIS | EN | |
|---|---|---|---|---|---|
| EN/DIS | X | X | 0 | 0 | Hi–z |
| | X | X | 0 | 1 | On |
| | X | X | 1 | 0 | Hi–z |
| | X | X | 1 | 1 | Hi–z |
| PWM/DIR | 0 | 0 | 0 | 1 | RL |
| | 0 | 1 | 0 | 1 | RL |
| | 1 | 0 | 0 | 1 | R |
| | 1 | 1 | 0 | 1 | F |

Fig 6a

| Val | Trl (μs) |
|---|---|
| 0000 | 0 |
| 0001 | 1 |
| 0010 | 2 |
| 0011 | 4 |
| 0100 | 8 |
| 0101 | 16 |
| 0110 | 32 |
| 0111 | 64 |
| 1000 | 128 |
| 1001 | 256 |
| 1010 | 512 |
| 1011 | 1024 |
| 1100 | 2048 |
| 1101 | 4096 |
| 1110 | 8192 |
| 1111 | 16384 |

Fig 6b

| Val | Tact (μs) |
|---|---|
| 0000 | 0 |
| 0001 | 1 |
| 0010 | 2 |
| 0011 | 4 |
| 0100 | 8 |
| 0101 | 16 |
| 0110 | 32 |
| 0111 | 64 |
| 1000 | 128 |
| 1001 | 256 |
| 1010 | 512 |
| 1011 | 1024 |
| 1100 | 2048 |
| 1101 | 4096 |
| 1110 | 8192 |
| 1111 | 16384 |

METHOD FOR CONTROLLING AND MONITORING AN ELECTROMAGNET, IN PARTICULAR IN A VARIABLE VALVE LIFT CONTROL DEVICE

BACKGROUND OF THE INVENTION

Field of the Invention

The present invention relates to a method for controlling and monitoring an electromagnet, in particular in a variable valve lift control device.

The invention has been provided in the automotive field and in particular in the field of engine control.

Description of the Related Art

In an internal combustion engine, a combustion chamber comprises at least one inlet allowing the intake into said chamber of a combustion agent and a fuel and an outlet for the discharge of the exhaust gases produced by the combustion of the combustion agent/fuel mixture. The intake flow and the outlet flow are potentially controlled, respectively, by an intake valve and by an exhaust valve. A camshaft controls the displacement of the valves in order to open said valves, said valves usually being closed by a spring.

For improved management of an internal combustion engine, it is preferable to have a law for the opening and closure of variable valves so as to be able to adapt in particular for example to the engine load and/or the engine operating speed (speed of rotation). It is thus known to provide a device for variable adjustment of the control for opening and closing the valves of an engine. A number of car models are marketed with such devices.

SUMMARY OF THE INVENTION

The present invention more particularly relates to a variable valve timing device which makes it possible to electronically select one cam profile from two different profiles. The switch from one cam profile to the other cam profile is performed with the aid of an electromagnet (comprising a solenoid), which positions and locks the selected cam profile. A spring activates the locking of the selected cam profile. The movement associated with the locking generates a signal for the solenoid, said signal being considered as an echo. As long as the locking has not been performed, no new switching action is allowed, which makes the detection of the echo indispensable.

It is also known to use an H bridge to control the polarity at the terminals of a dipole. Such an H bridge comprises four switching elements arranged schematically in an H shape. A switching element is arranged between each terminal of the dipole and a voltage source. A switching element is arranged between each terminal of the dipole and a reference potential, for example a ground. The switching elements for example may be relays or transistors.

An H bridge is used in particular in power electronics. In the automotive field it is known in particular to use an H bridge for electronic throttle control (ETC), for the electronic control of an exhaust gas recirculation (EGR) valve, or for the electronic control of DC current motors.

The original concept forming the basis of the present invention is that of controlling an electromagnet of a variable valve lift (VVL) device. In fact, an H bridge, a priori, has not been designed for controlling an electromagnet solenoid and cannot provide a verification of the position of an electromagnet core.

The object of the present invention is thus to provide means making it possible to control an electromagnet solenoid with the aid of an H bridge whilst also being able to verify, after control, the locking of the corresponding electromagnet core.

The proposed solution will of course be adapted advantageously to the automotive field and more particularly to the management of a device of the VVL type allowing variable valve lift in an internal combustion engine.

The means to be used will preferably be easily implemented.

In the field of internal combustion engine management a microcontroller at the least manages the combustion. The number of inlets/outlets on the corresponding microcontroller advantageously will be as low as possible.

To this end, the present invention proposes a method for controlling and monitoring an electromagnet comprising a solenoid through which a current can be passed in one direction and in the opposite direction, the electromagnet thus enabling a selection of the position of an element between two predetermined positions.

In accordance with the invention the solenoid is controlled by an H bridge having a first transistor connecting a first terminal of the solenoid to a voltage source, a second transistor connecting the first terminal of the solenoid to a reference potential, a third transistor connecting a second terminal of the solenoid to the voltage source, and a fourth transistor connecting the second terminal of the solenoid to the reference potential. The H bridge is connected to a microcontroller by a computer link.

The method according to the invention comprises the following steps: once a current flows in the solenoid, the microcontroller sends instructions via the computer link so that the bridge switches into a state referred to as the 'third state', in which all the transistors are blocked and prevent current from flowing, and a measurement is taken at the terminals of the solenoid in order to verify a locked state of the element controlled by the electromagnet.

It is thus possible to ensure the management and the control of an electromagnet. The H bridge makes it possible to control in a conventional manner the direction of flow of a current in a load and here makes it possible to select one or other of the positions of the controlled element depending on the selected direction of flow. By isolating the electromagnet by causing the H bridge to switch to high impedance, a measurement is then taken at the terminals of the solenoid of the electromagnet in order to verify the effective locking (or not) of the element controlled by the electromagnet in the selected position.

In accordance with one embodiment of the invention the current passing through the solenoid is activated in the event of a change of state of a direction control. Thus, it is possible to control the current passing through the solenoid in a simple manner. In order to avoid control conflicts, which could cause damage to the solenoid during the control of the current by the control signal, a delay is provided between the change of the direction control and the cessation of the activation of the current passing through the solenoid.

In accordance with one embodiment of the invention a delay is provided between the cessation of the flow of the current in the solenoid and the switch to high impedance of the H bridge. During this delay, the solenoid is short-circuited for example. The H bridge is then in a state commonly referred to as freewheel, that is to say the two transistors connecting the solenoid to the voltage source thereof or to the reference potential thereof are open, the two other transistors being closed. At the end of this delay the H bridge passes automatically to high impedance.

The measurement taken at the terminals of the solenoid in order to verify the locked state of the element controlled by the electromagnet may consist in measuring the voltages at the terminals of the solenoid.

In an optimized embodiment limiting the number of signals necessary for the control of the device, a first signal may control the direction of circulation of the current in the solenoid and a second signal may control the flow or absence of flow of current in the solenoid. In this embodiment it may then be that when the second signal becomes zero, the H bridge switches into the third state thereof after a possible delay.

The present invention also relates to a device for controlling a variable valve lift device having two different cam profiles as well as an electromagnet with a solenoid making it possible to select one or other of the cam profiles, said control device comprising a microcontroller associated with means making it possible to allow a current to flow either in one direction or in an opposite direction in the solenoid as well as means for checking the locking of the cam profile in the selected position, the control device being noteworthy in that the means making it possible to allow a current to flow either in one direction or in the opposite direction in the solenoid comprise an H bridge connected by a computer link to the microcontroller, said H bridge having a first transistor connecting a first terminal of the solenoid to a voltage source, a second transistor connecting the first terminal of the solenoid to a reference potential, a third transistor connecting a second terminal of the solenoid to the voltage source, and a fourth transistor connecting the second terminal of the solenoid to the reference potential.

Such a device is a device allowing the implementation of the present invention suitable for a variable lift valve device having two different cam profiles.

The present invention more generally relates to any device allowing the implementation of each of the steps of a method according to the present invention.

In a device according to the present invention the computer link is preferably a link of the serial peripheral interface type.

The present invention also relates to an internal combustion engine comprising a variable valve lift device, noteworthy in that it further comprises a control device as described above.

BRIEF DESCRIPTION OF THE DRAWINGS

Details and advantages of the present invention will become clearer upon reading the following description, which is provided with reference to the accompanying schematic drawing, in which:

FIG. 6*a* is a table illustrating delay programming for implementation of the present invention, and FIG. 6*b* is a table in accordance with another exemplary embodiment illustrating delay programming for implementation of the present invention.

DESCRIPTION OF THE PREFERRED EMBODIMENT

Figure 1:
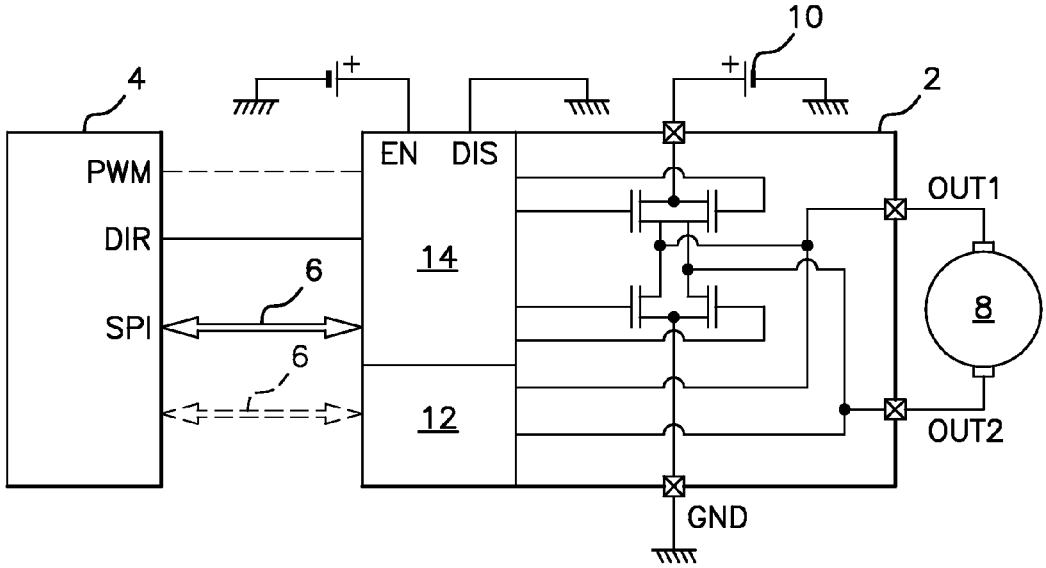
FIG. 1 is a schematic view of a control device according to the present invention, FIG. 2 schematically illustrates an operation of an H bridge.

FIG. 1 illustrates a control device according to the present invention comprising an electronic circuit 2 and a microcontroller 4 connected to this circuit by a computer link 6. This link for example is an SPI (serial peripheral interface) link, that is to say a synchronous serial data bus that establishes a master/slave relationship between the connected components. Here, the microcontroller 4 acts as a master and sends data (instructions) to the electronic circuit 2.

In the present description the electronic circuit 2 is a circuit for controlling an electromagnet 8, and more particularly an electromagnet of a variable valve lift (VVL) device in an internal combustion engine. The VVL device comprises the electromagnet 8, which makes it possible to select one cam profile from two different cam profiles for the operation of the associated valve. The electromagnet 8 comprises a solenoid supplied with current from a battery 10. Depending on the direction of flow of the current in the solenoid, the electromagnet 8 selects one or other of the cam profiles.

Figure 2:
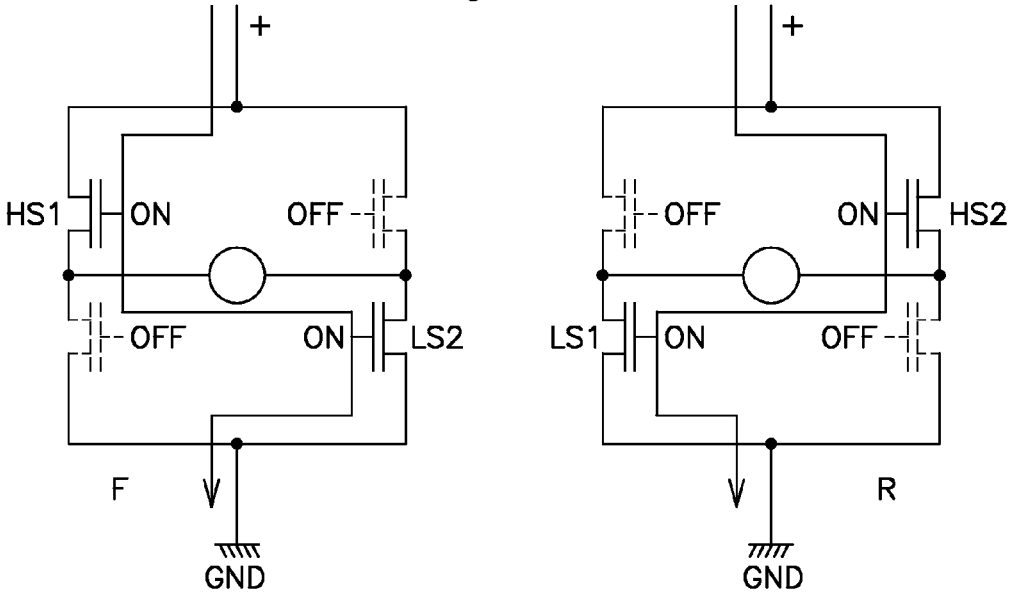

The electronic circuit 2 includes an H bridge comprising, as is conventional, four transistors referred to here as HS1, HS2, LS1 and LS2. These transistors are generally controlled asymmetrically, as illustrated in FIG. 2. Thus, HS1 and LS2 will be conductive and the H bridge will be in a state referred to as F (for "forward") so as to select a first cam profile, whereas HS2 and LS1 will be conductive and the H bridge will be in a state referred to as R (for "reverse") so as to select the second cam profile.

The electronic circuit 2 is supplied by the battery 10 and is also connected to a reference potential, advantageously a ground GND as illustrated here. The H bridge for its part has two outputs corresponding to the terminals OUT1 and OUT2 in FIG. 1. The terminals of the solenoid of the electromagnet 8 are connected to the output terminals OUT1 and OUT2 of the H bridge. From an electrical viewpoint, the output terminals OUT1 and OUT2 of the H bridge are confounded with the terminals of the associated load, here the solenoid of the electromagnet 8.

The electronic circuit 2 illustrated in FIG. 1 also comprises a measuring device 12 which makes it possible to measure the voltage at the terminals of the solenoid (thus also at the output terminals OUT1 and OUT2 of the H bridge). This measuring device 12 can be connected by means of an interface 14 and the link 6 to the microcontroller 4, or may have its own link 6 to the microcontroller (in fact, the measuring device 12 is not necessarily integrated in the H bridge). The information corresponding to the measurements taken by the measuring device 12 can thus be sent to the microcontroller 4. The interface 14 is also used for the control of other components of the electronic circuit 2 and in particular the transistors HS1, HS2, LS1 and LS2 as explained hereinafter.

The only control signal still required among the conventional control signals of an H bridge is the direction signal, which assumes the value 0 or 1. The other conventional signals EN ("enable"), DIS ("disable"), PWM ("pulse width modulation") are not necessary. If these exist due to a general design, they can be polarized so as to allow the operation (EN=1; DIS=0).

When a motor is branched between the terminals OUT1 and OUT2, the signal PWM makes it possible to modulate the current flowing in the motor and therefore to vary the speed of rotation of this motor. It will be supposed hereinafter that the signal PWM is modulated either 0% or 100%, and therefore this signal can be considered as a signal assuming either the value 0 (0% modulation) or the value 1 (100% modulation). In one of the embodiments this signal is not taken into consideration.

Figures 3, 4:
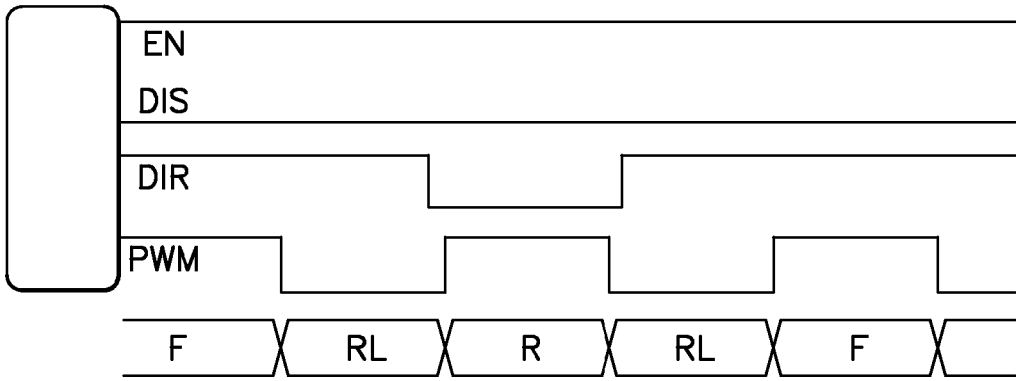
FIG. 3 is a table indicating various states of an H bridge depending on parameters in 'normal' operation.
FIG. 4 illustrates 'normal' operation of an H bridge.

The table of FIG. 3 illustrates the main states of an H bridge in a normal operating mode depending on the signals EN, DIS, DIR and PWM. When the signal DIS is 1, the H bridge is inoperative and the four corresponding transistors are in the blocked state. In this case the H bridge is in a state referred to as the "tri-state" or "high impedance" ("Hi-Z" in the figures). This is also the case when the signal DIS is 0 but the signal EN is not 1, therefore is 0. In these three cases the value of the signals PWM and DIR is irrelevant since the transistors remain blocked.

Thus, in order for the H bridge to operate in a 'normal' operating mode, the signal EN must be 1 and the signal DIS must be 0. The lower part of the table concerns this state. The values of the signals PWM and DIR make it possible to act on the H bridge.

In the normal operating state, when the signal PWM is 0, no current is summoned to circulate in the load mounted between the terminals OUT1 and OUT2: the H bridge is in a state referred to commonly as "freewheel" or RL in the figures. Depending on the design choice either the transistors HS1 and HS2 will be conductive and the transistors LS1 and LS2 will be blocked, or vice versa.

When the signal PWM is not zero a current is summoned to flow in the load mounted between the terminals OUT1 and OUT2. Depending on the value of DIR this current will flow in one direction or in another. It is supposed for example that when DIR is 0 the current flows in the direction R illustrated in the right-hand schema of FIG. 2, and that when DIR is 1 the current flows in the direction F illustrated in the left-hand schema of FIG. 2.

FIG. 4 illustrates the normal operating mode of the H bridge in the form of a graph. It is supposed here that the signal EN remains at its value 1 and the signal DIS remains at its value 0. It is noted that the H bridge switches to freewheel as soon as the signal PWM passes to 0, and if not the direction of flow of the current in the load mounted between the terminals OUT1 and OUT2 is dependent on the value of the signal DIR.

The present invention proposes operating modes other than this normal mode when an electromagnet, such as the electromagnet 8, is controlled.

For an application with a variable valve lift (VVL) device in which it is advisable to select a first cam profile or a second cam profile, it is advisable to lock the device in the selected position and, by way of security, to check that said device is effectively locked in this position.

The original concept of the present invention is to use an H bridge to control the electromagnet 8 having to select the correct cam profile and ensure effective locking. This therefore no longer involves controlling a motor or a rotating load, as is usually performed by the H bridges, but instead involves a device making it possible to select one position from two positions (F or R). In addition, it is necessary to perform an operation for verification of locking in the selected position.

The invention thus proposes using two states F and R (described above) of an H bridge in order to control the electromagnet 8 and select one or other of the cam profiles. The state F will be used to select a first cam profile, whereas the state R will be used to select the second cam profile.

Once the current has flowed in the selected direction in the solenoid of the electromagnet 8, it is necessary to then check whether the variable valve lift device is correctly positioned. This check can be performed by measuring the voltages at the terminals of the solenoid, that is to say at the output terminals OUT1 and OUT2 of the H bridge. In order to take this measurement, the H bridge must be in the high impedance state, in which the electromagnet 8 is electrically isolated. The microcontroller 4 then orders the switching into the third state when a measurement has to be taken.

In a normal operating mode, in order to switch into the third state, the signal DIS for example is influenced. By switching this signal to 1, the H bridge passes into the third state thereof. It is also possible to switch the value of the signal EN from 1 to 0 in the normal operating mode.

Such a solution has the disadvantage of providing an output DIS (and/or EN) for each valve, thus increasing the number of digital inputs/outputs necessary for the control of the corresponding motor. The output PWM could possibly be spared.

The present invention then proposes, in a preferred embodiment, using operating modes of the H bridge referred to as modes VVL1 and VVL2. These modes (illustrated in FIGS. 5*a* and 5*b* in particular) are programmed in the microcontroller 4 and transmitted via the link 6 to the interface 14 for the control of the electronic circuit 2.

In the operating modes VVL1 and VVL2 the microcontroller 4 causes the H bridge to switch to high impedance once a switch has been made from one cam profile to another cam profile by the electromagnet 8. In this third state the measuring device 12 can then measure the voltages at the terminals OUT1 and OUT2 and can thus check the locked state or not of the electromagnet 8. The information concerning the measurements taken is either transmitted to the microcontroller 4 via the interface 14 and the link 6, or directly via the link 6 specific to the interface 12.

Figure 5A:
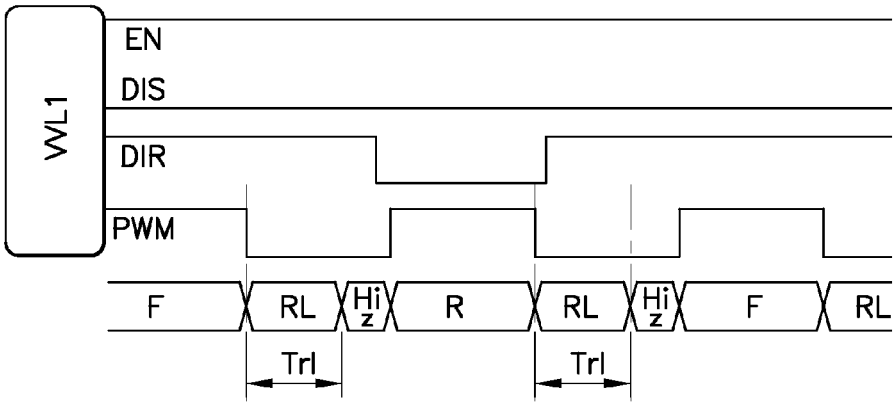
FIG. 5*a* illustrates an operation of the H bridge of FIG. 1.

In the embodiment of the mode VVL1, illustrated in FIG. 5*a*, the microcontroller 4 sends via the link 6 the necessary instructions that will switch the H bridge to freewheel state when the signal PWM assumes the value 0. When the freewheel state starts, it is then maintained for a predetermined period referred to as Trl, then the H bridge switches into high impedance. The measurement is then taken by the measuring device 12 and is transmitted to the microcontroller 4.

As illustrated in FIG. 5*a*, the H bridge, in the operating state VVL1, can switch into high impedance after a freewheel time Trl.

The operating mode VVL1 advantageously acts independently of the values of the signals EN and DIS. These, for example, can assume the values 1 and 0 respectively, such that the microcontroller 4, from the viewpoint of the internal logic, still considers the valve control system to be operational, even if the transistors of the H bridge are open.

The delay time Trl can be adjusted, for example depending on the engine speed. The table of FIG. 6*a* proposes 4-bit programming of the operation in mode VVL1 and of the delay prior to the measurement of the voltages. The first column of the table corresponds to the possible 4-bit combinations. These bits make it possible to determine the duration (in microseconds or μs) of the delay Trl. In the given example a delay of approximately 16 ms is thus obtained.

Figure 5B:
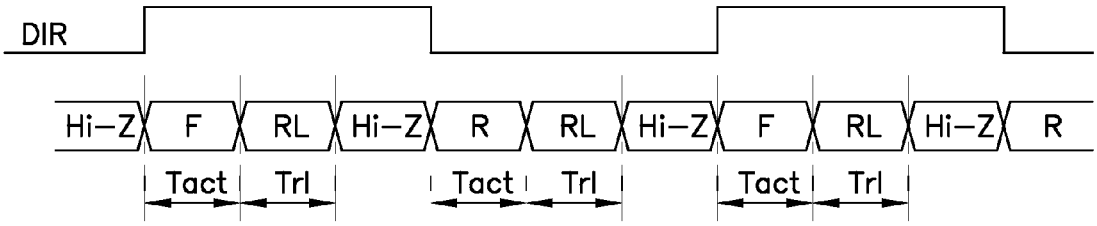
FIG. 5*b* illustrates an operation of the H bridge of FIG. 1 in accordance with another embodiment.

The operating mode VVL2 is to act without necessarily changing the state of the signal PWM, and thus makes it possible to spare such an output on the microprocessor. The phase of activation of duration Tact (which would correspond to the duration in which PWM=1 in the mode VVL1) is then indexed to the change of direction, as shown in FIG. 5*b*. The activation phase is followed by a freewheel phase of duration Trl (as in the mode VVL1), which is then succeeded by a high impedance phase, which lasts until the next change of direction. The times Tact and Trl may vary by programming, and the tables in FIGS. 6*a* and 6*b* give an example of coding of the durations Tact and Trl.

The present invention thus makes it possible to manage and control an electromagnet of a device of the VVL type at lower cost. It would appear to the person skilled in the art that this management can be applied to other electromagnets. The components used here are components conventionally used in the automotive industry, and the proposed solution is thus particularly well suited to this industry.

In an advantageous embodiment it is possible to spare control outputs on a microcontroller used. As a result, the bulk of the device according to the invention can be limited.

Of course, the present invention is not limited to the preferred embodiment of the invention described above, but also concerns variants within the capability of the person skilled in the art on the basis of the indications given in the present description.

The invention claimed is:

1. A method for controlling and monitoring an electromagnet (8) that incorporates a solenoid through which a current can be passed in a first direction and in an opposite second direction such that the electromagnet selectively positions an element between two predetermined positions, the method comprising:

providing an H bridge that controls the solenoid, said H bridge having a first transistor connecting a first terminal of the solenoid to a voltage source (10), a second transistor connecting the first terminal of the solenoid to a reference potential (GND), a third transistor connecting a second terminal of the solenoid to the voltage source (10), and a fourth transistor connecting the second terminal of the solenoid to the reference potential (GND), the H bridge being in connection with a microcontroller (4) by way of a computer link (6);

at the microcontroller (4), upon a determination that current flows in the solenoid, sending instructions via the computer link (6) to the H bridge so that the H bridge switches into a third state, in which all the first, second, third, and fourth transistors are blocked and prevent current from flowing; and verifying whether the element controlled by the electromagnet (8) is in a locked state by taking a measurement at the first and second terminals of the solenoid.

2. The method as claimed in claim 1, wherein, upon detection of a change of state of a direction control, the current passing through the solenoid is activated.

3. The method as claimed in claim 2, wherein a delay (Tact) is provided between the change of the state of the direction control and a cessation of the activation of the current passing through the solenoid.

4. The method as claimed in claim 3, wherein a delay (Trl) is provided between a cessation of activation of current in the solenoid and a switching to high impedance of the H bridge.

5. The method as claimed in claim 3, wherein the measurement taken at the first and second terminals of the solenoid in order to verify the locked state of the element controlled by the electromagnet (8) consists in measuring voltages at the first and second terminals of the solenoid.

6. The method as claimed in claim 2, wherein a delay (Trl) is provided between a cessation of activation of current in the solenoid and a switching to high impedance of the H bridge.

7. The method as claimed in claim 2, wherein the measurement taken at the first and second terminals of the solenoid in order to verify the locked state of the element controlled by the electromagnet (8) consists in measuring voltages at the first and second terminals of the solenoid.

8. The method as claimed in claim 1, wherein a delay (Trl) is provided between a cessation of activation of current in the solenoid and a switching to high impedance of the H bridge.

9. The method as claimed in claim 8, wherein the solenoid is no longer short-circuited after the delay (Trl).

10. The method as claimed in claim 9, wherein the measurement taken at the first and second terminals of the solenoid in order to verify the locked state of the element controlled by the electromagnet (8) consists in measuring voltages at the first and second terminals of the solenoid.

11. The method as claimed in claim 9, wherein a first signal (DIR) controls a direction of circulation of the current in the solenoid and a second signal (PWM) controls a flow or absence of flow of current in the solenoid.

12. The method as claimed in claim 8, wherein the measurement taken at the first and second terminals of the solenoid in order to verify the locked state of the element controlled by the electromagnet (8) consists in measuring voltages at the first and second terminals of the solenoid.

13. The method as claimed in claim 8, wherein a first signal (DIR) controls a direction of circulation of the current in the solenoid and a second signal (PWM) controls a flow or absence of flow of current in the solenoid.

14. The method as claimed in claim 1, wherein the measurement taken at the terminals of the solenoid in order to verify the locked state of the element controlled by the electromagnet (8) consists in measuring voltages at the first and second terminals of the solenoid.

15. The method as claimed in claim 14, wherein a first signal (DIR) controls a direction of circulation of the current in the solenoid and a second signal (PWM) controls a flow or absence of flow of current in the solenoid.

16. The method as claimed in claim 1, wherein a first signal (DIR) controls the direction of circulation of the current in the solenoid and a second signal (PWM) controls a flow or absence of flow of current in the solenoid.

17. The method as claimed in claim 16, wherein when the second signal (PWM) becomes zero, the H bridge switches into a high impedance state thereof.

* * * * *